United States Patent [19]

Johansen

[11] 4,142,261

[45] Mar. 6, 1979

[54] ARRANGEMENT IN SANITARY CLOSET SYSTEMS

[76] Inventor: Ole B. Johansen, Asmundtorp 147, 430 61 Härryda, Sweden

[21] Appl. No.: 786,187

[22] Filed: Apr. 11, 1977

[30] Foreign Application Priority Data

Apr. 27, 1976 [SE] Sweden ..... 7604803
Jul. 16, 1976 [SE] Sweden ..... 7608125

[51] Int. Cl.[2] ..... E03D 5/014; E03D 11/10

[52] U.S. Cl. ..... 4/300; 4/442; 4/DIG. 19; 210/152; 210/320

[58] Field of Search ..... 4/1, 10, 84, 85, 115, 4/116, 114, 286, 288, 290, 292, DIG. 14, DIG. 19, 300, 317–319, 321, 323, 420, 441, 442; 210/152, 303, 305, 320, 519

[56] References Cited

U.S. PATENT DOCUMENTS

| | | | |
|---|---|---|---|
| 1,303,358 | 5/1919 | Montgomery | 4/DIG. 19 |
| 3,655,048 | 4/1972 | Pergola | 210/152 X |
| 3,798,681 | 3/1974 | Johansen | 4/84 X |

FOREIGN PATENT DOCUMENTS

| | | | |
|---|---|---|---|
| 1323648 | 3/1963 | France | 4/115 |

*Primary Examiner*—Stuart S. Levy
*Attorney, Agent, or Firm*—Harness, Dickey & Pierce

[57] ABSTRACT

An improved sanitary water closet wherein the soil pipe leading to the sludge tank, passes through a flushing container and is formed inside the latter with a bend provided with grid means arranged to allow passage through of liquid into the container and further to a septic tank, but to divert solid material to the sludge tank. Because of the separation of liquid and solid products, the sludge product obtained in the sludge tank contains very little moisture and is therefore easily biologically degradable.

6 Claims, 7 Drawing Figures

ARRANGEMENT IN SANITARY CLOSET SYSTEMS

BACKGROUND OF THE INVENTION

In small communities or areas with scattered houses where the drains of the buildings are not connected to sewage disposal systems which include installations for cleaning the sewage, the authorities as a rule do not allow faeces and urine to be drained off without further delivery to septic tanks or so called culverts, as the faeces would contaminate the local ground water.

SUMMARY OF THE INVENTION

The present invention aims at solving this problem and likewise to make it possible to use water closets which ordinarily have not been allowed for use in areas of the afore-mentioned kind. More precisely, the invention concerns sanitary closets comprising a flushing basin positioned below the sanitary closet bowl seat and connected to a sludge tank via a soil pipe which slopes down towards the tank and wherein is provided a means for separating the flushing liquid and the urine from the faeces before the latter pass to the sludge tank. It is characteristic of the invention that the soil pipe passes through a flushing container and is formed inside the latter with a bend the downstream side of which is in the form of or provided with, a grid arranged to allow passage through of liquid to the container but to divert the faeces and toilet paper to the sludge tank. The sludge tank is emptied into a sludge collection van in the conventional manner by means of special equipment. The urins together with the flushing liquid, on the other hand, pass to a septic tank or a culvert, wherein they are mixed, and diluted with the drain water from the kitchen, etc. The urine and kitchen garbage are easily degradable in soil and do not cause harmful pollution to the ground.

This efficient separation of liquid from the faeces is of extreme importance in order that a sludge product be obtained inside the sludge tank which is sufficiently firm — contains a sufficiently small amount of liquid — to be biologically degradable later on and be used as a soil-enriching product.

BRIEF DESCRIPTION OF THE DRAWINGS

Further characteristics of the invention will become apparent upon reading of the following description with reference to the accompanying drawings, wherein.

DETAILED DESCRIPTION OF PREFERRED EMBODIMENTS

Figures 1, 2:
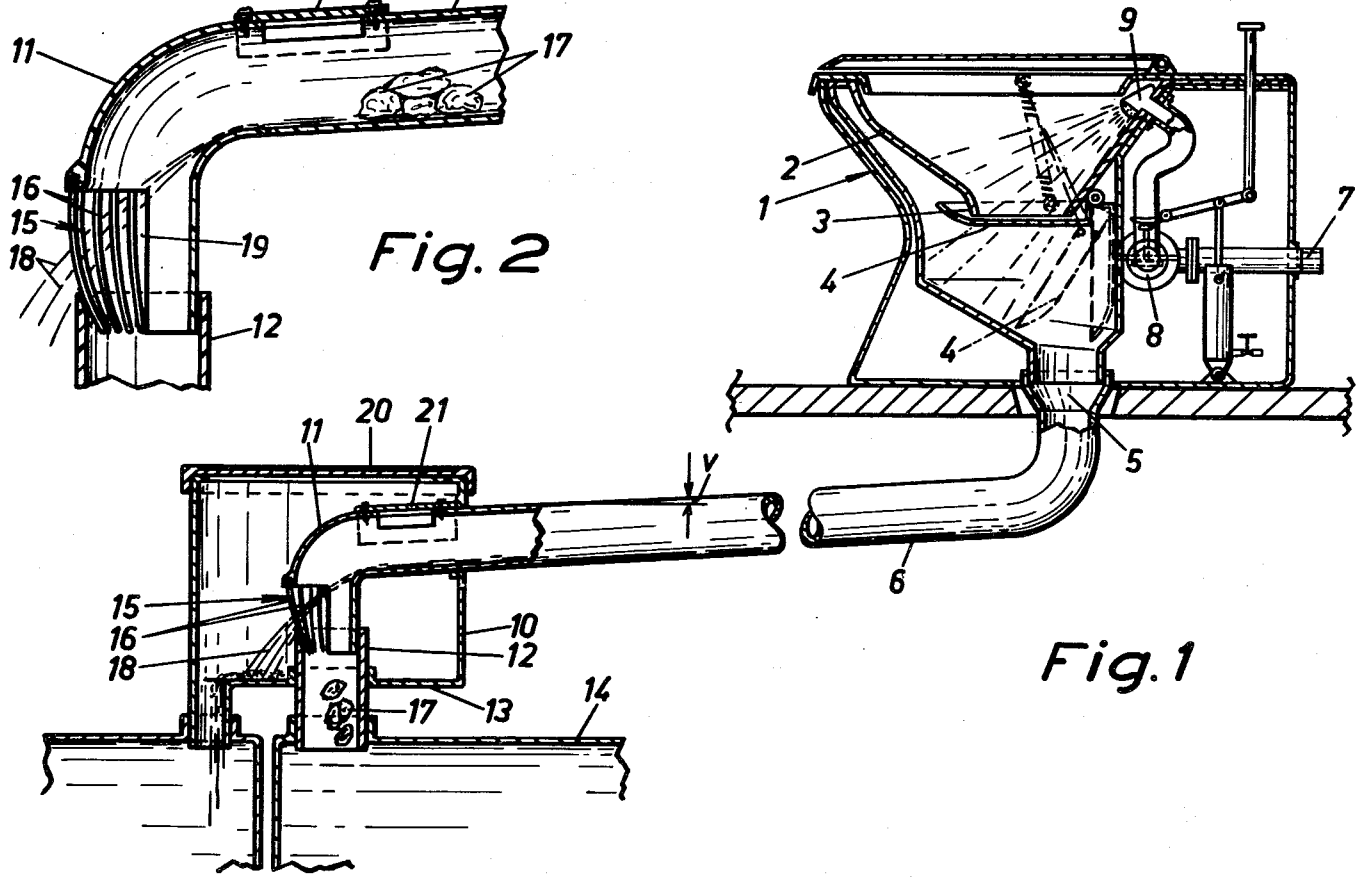
FIG. 1 is a vertical sectional view through a sanitary closet including a soil pipe provided with the device in accordance with the invention.
FIG. 2 illustrates on an enlarged scale a vertical longitudinal sectional view through one enbodiment of the separating device in accordance with the invention, incorporated into the sanitary closet.

The seat 2 of the sanitary closet bowl 1 is funnel-shaped and the lower mouth 3 thereof is positioned above a flushing basin 4 which is pivotally mounted and serves as a waterseal above the upper end 5 of a soil pipe 6. At the top, the closet bowl 2 is provided with a sparying nozzle 9 which via a valve 8 is connected to a pressure water pipe 7. The soil pipe 6 which preferably has an internal diameter of between 60 and 75 mm, slopes downwards at an angle v of preferably 5–15°, towards a flushing container 10, passing through the wall thereof. The lower end of the soil pipe is in the shape of a downwardly directed bend 11 the lower end of which is inserted into a vertical pipe 12 passing through the bottom 13 of the flushing container 10 and discharging into a sludge tank 14.

Figure 3:
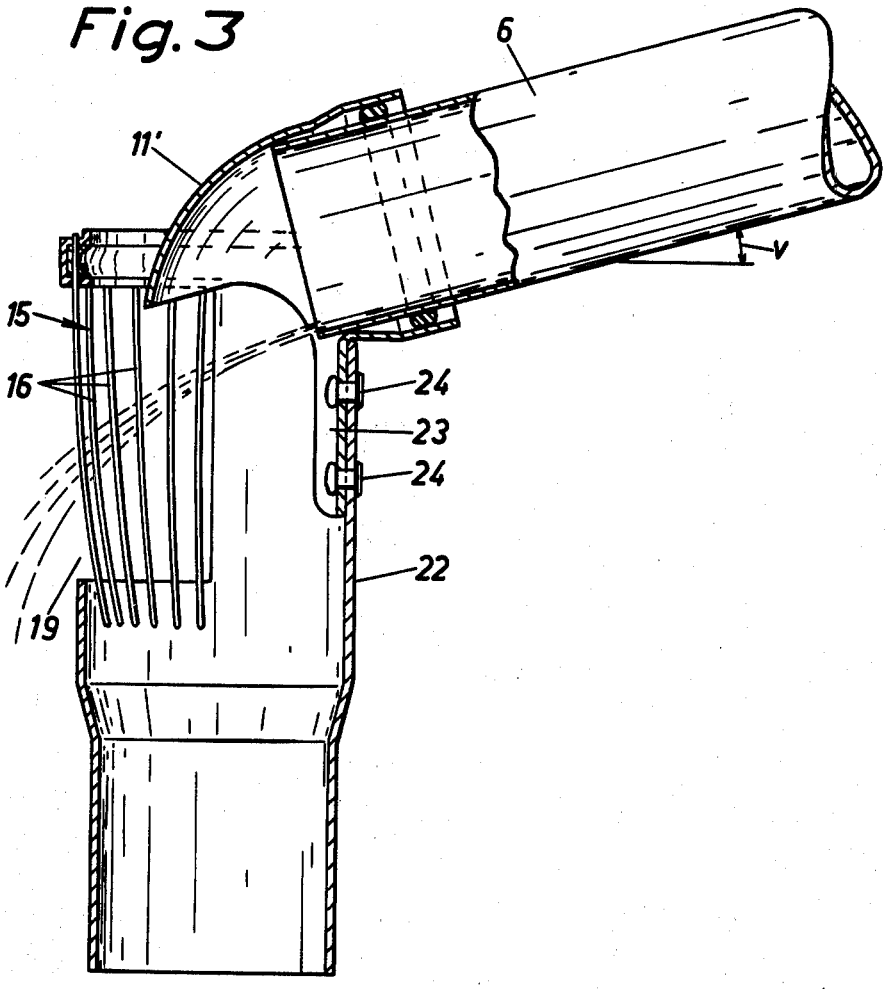
FIG. 3 illustrates a similar sectional view through a separating device in accordance with another embodiment.
Figure 4:
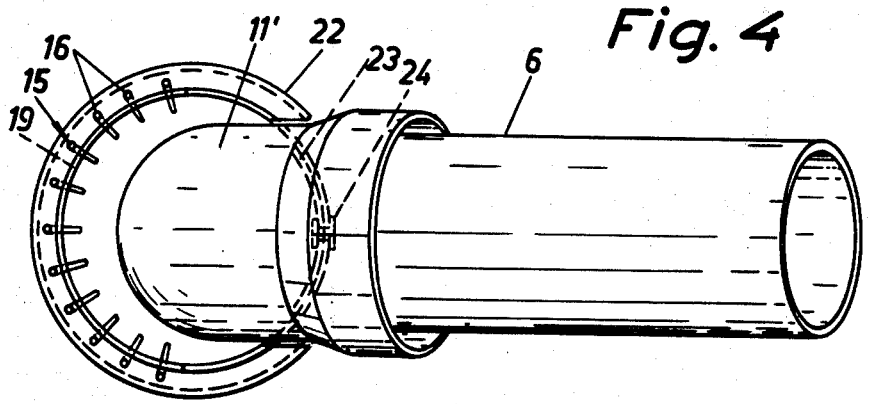
FIG. 4 is a plan view of the device of FIG. 3.

At the lower end of the pipe bend 11, at the left side as seen in the drawings, and on the downstream side there is provided a grid 15 which in accordance with the embodiments shown in FIGS. 2, 3 and 4 consists of a number of downwardly directed and somewhat spaced rods 16 of stainless steel, positioned in front of an opening 19 formed in the wall of the pipe bend, the upper end of said rods 16 moulded or in some other way secured to the wall of the pipe bend above the opening 19. The purpose of this grid is to divert the faeces 17 flowing down the soil pipe 6, down through the pipe 12 and into the sludge tank 14, whereas the flushing liquid 18 in which the faeces are transported through the soil pipe, on account of its comparatively high flow velocity, passes between the rods 16 of the grid 15 and is collected in the flushing container 10.

The sludge tank 14 is provided with an outlet (not shown) to allow the tank to be emptied, and the flushing container 10 is provided with a drainage conduit (not shown) leading to a septic tank or the like.

When after using the toilet one opens the valve 8, flushing liquid is sprayed from the nozzle 9, whereupon the basin 4 is swung to the opening position (indicated in broken lines in FIG. 1). Faeces and toilet paper are transported in the flushing liquid, down through the pipe 6. On account of the inclination of the pipe 6, the flow velocity of the liquid will be sufficiently high to allow faeces, toilet paper and any other objects that may be thrown into the toilet, to pass the bend 11 where, as mentioned above, the solid objects (faeces and toilet paper) are guided by the grid 15, down to the sludge tank 14, whereas at least the major portion of the flushing liquid, on account of the considerable flow velocity passes between the grid rods 16 and is collected in the container 10 from which it is conducted e.g. to a septic tank.

Figure 5:
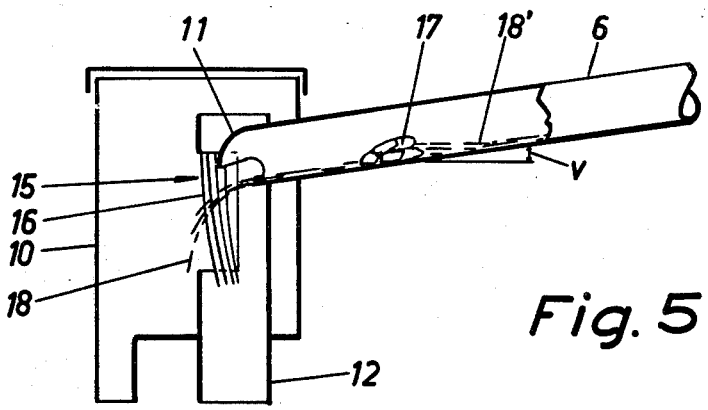
FIGS. 5, 6 and 7 show diagrammatically the manner in which the separation of the flushing liquid from the faeces takes place.
Figure 6:
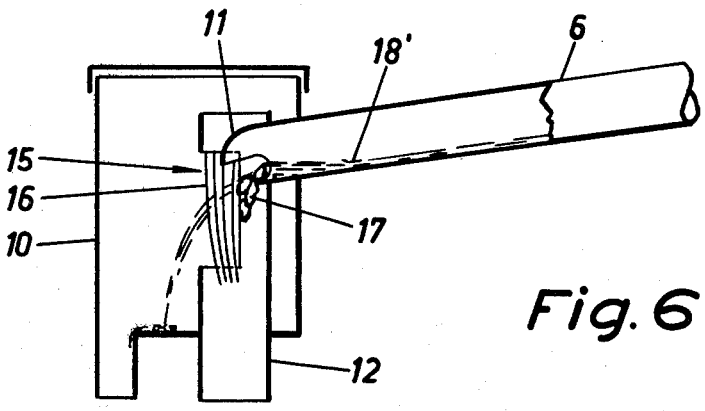
Figure 7:
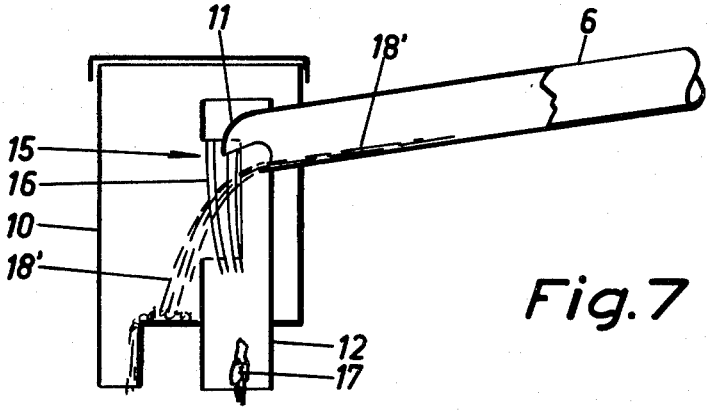

The course of events is illustrated in a schematic form in FIGS. 5–7. Initially, a certain quantity of liquid 18 (FIG. 5) will, as a result of the inclinaction of the soil pipe, be jetted through the grid 15 into the container 10 at a sufficient speed. The faeces 17 and the toilet paper (FIG. 6) then follow, which solid particles to a large extend fill the cross-section of the soil pipe. These particles are diverted by the pipe bend 11 and wall on the downstream side thereof so as to pass by (drop past) the grid 15 and fall straight down into the sludge tank. Owing to the arrangement of the grid rods such that the inwardly bent ends thereof extend (are suspended) freely down into the vertical portion 12 of the soil pipe, leading to the sludge tank 14, there is no tendency whatsoever that the grid will be clogged. The paper and the faeces quite simply slide along the rods 16, dropping away from the lower free ends thereof at the lower edge of the grid. Following the faeces, a further quantity of liquid 18' (FIG. 7) is flushed through the soil pipe, which liquid likewise is jetted at a required speed through the grid 15 into the container 10.

The flushing container 10 is provided with a lid 20, making the interior of the container accessible for cleaning, if required. The pipe bend 11 is provided with a clean-out door 21, whereby it becomes possible to clean the soil pipe 6 and the grid 15 from the inside, if necessary.

In accordance with the embodiment as illustrated in FIGS. 3 and 4, the grid 15 is formed in a separate, open top pipe 22 which is intended to be inserted into the upper end of the pipe 12 (FIG. 1) leading to the sludge tank 14. This pipe 22 may also replace the pipe 12. The pipe bend 11' into which the pipe 6 discharges, is formed with a downwardly directed tongue 23 which engages the upper end of the pipe 22 and which is secured to the latter, e.g. by means of pop rivets. A separating device of this kind is cheap to manufacture and easy to install.

The embodiments as shown and described are to be regarded as examples only, and the various parts of the toilet installation may be constructively altered in a variety of ways within the scope of the appended claims. The grid rods 16 may be formed by rod-shaped sections of the wall of the pipe bend 11, which preferably is made from synthetic resins, these rod-shaped sections being free at their lower ends. Instead of being conveyed to a sludge tank, the feaces may be transported to a desintegrating installation.

What I claim is:

1. In an improved sanitary closet comprising a seat, a flushing basin positioned below the seat, a soil pipe, a flushing container and a sludge tank, said soil pipe having a sloping portion down to said flushing container and passing through said flushing container and interconnecting said flushing basin and said sludge tank, the improvement comprising a bend in said soil pipe located inside said flushing container and between said sloping portion and said sludge tank, the portion of the soil pipe downstream of the bend extending downwardly in a vertical direction, and a grid means located on the downstream portion of said bend with said grid means being located in a side wall of the downwardly extending portion of said soil pipe and adjacent to the bottom of the sloping portion of said soil pipe in opposition to flow of flushing liquid and urine, whereby flushing liquid and urine passes through said grid means to said flushing container and faeces and toilet paper passes through said soil pipe to said sludge tank.

2. An improved sanitary closet as claimed in claim 1, wherein said grid means comprises a plurality of vertical rods.

3. An improved sanitary closet as claimed in claim 1, wherein said flushing container is connected to a collection means by a drainage pipe.

4. An improved sanitary closet as claimed in claim 1, comprising a number of pendent rods forming said grid means, the lower end of said rods extending inside the wall of said soil pipe.

5. An improved sanitary closet as claimed in claim 4, wherein the portion of the soil pipe downstream of the bend includes a pipe leading down into said sludge tank.

6. An improved sanitary closet as claimed in claim 5, wherein the portion of said soil pipe leading down into the sludge tank includes an open top pipe.

* * * * *